US009608347B2

(12) United States Patent
Nagata et al.

(10) Patent No.: US 9,608,347 B2
(45) Date of Patent: Mar. 28, 2017

(54) RIGHT-ANGLE ELECTRICAL CONNECTOR

(71) Applicant: HIROSE ELECTRIC CO., LTD., Tokyo (JP)

(72) Inventors: Masakazu Nagata, Tokyo (JP); Atsushi Matsuzawa, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/138,444

(22) Filed: Apr. 26, 2016

(65) Prior Publication Data

US 2016/0322722 A1 Nov. 3, 2016

(30) Foreign Application Priority Data

Apr. 28, 2015 (JP) ..... 2015-091249

(51) Int. Cl.

| | |
|---|---|
| ***H01R 12/00*** | (2006.01) |
| ***H01R 12/70*** | (2011.01) |
| ***H01R 12/72*** | (2011.01) |
| ***H01R 12/73*** | (2011.01) |

(52) U.S. Cl.

CPC ..... *H01R 12/707* (2013.01); *H01R 12/724* (2013.01); *H01R 12/737* (2013.01)

(58) Field of Classification Search

CPC .. H01R 12/707; H01R 12/737; H01R 12/724; H01R 13/20; H01R 12/716; H01R 13/41; H01R 23/6873

See application file for complete search history.

(56) References Cited

U.S. PATENT DOCUMENTS

| | | | | |
|---|---|---|---|---|
| 5,127,839 | A * | 7/1992 | Korsunsky | H01R 12/716 439/108 |
| 5,199,885 | A * | 4/1993 | Korsunsky | H01R 23/6873 439/79 |
| 5,931,689 | A * | 8/1999 | Patel | H01R 13/20 439/346 |
| 8,435,052 | B2 | 5/2013 | Potters | |
| 2001/0049213 | A1 * | 12/2001 | Potters | H01R 13/41 439/80 |

* cited by examiner

*Primary Examiner* — Jean F Duverne

(74) *Attorney, Agent, or Firm* — Procopio, Cory, Hargreaves & Savitch LLP

(57) ABSTRACT

In a housing 10 are formed holding grooves 17A to 17D that permit arm-use blades 20A-1 to 20D-1 of various types of blades 20A to 20D to be inserted from the rear, connection components 33A-1 to 33D-1 provided to the lower ends of legs 33A to 33D of conductive bar members 30A to 30D of the various types of blades 20A to 20D are located outside the housing, the arm-use blades 20A-1 to 20D-1 of the various types of blades 20A to 20D are able to move in the vertical direction over a specific range within the corresponding holding grooves 17A to 17D, and the various types of blades 20A to 20D are able to move within a holding space 17.

5 Claims, 7 Drawing Sheets

RIGHT-ANGLE ELECTRICAL CONNECTOR

The present application claims the benefit of foreign priority under 35 USC §119 based Japanese Patent Application No. 2015-091249, filed Apr. 28, 2015, the contents of which is incorporated herein in its entirety by reference.

BACKGROUND

1. Technical Field

The present invention relates to a right-angle electrical connector.

2. Related Art

A so-called right-angle electrical connector is known from Patent Document 1, in which the extension direction of terminals with respect to a circuit board and the mating direction with respect to a mating connector form a right angle. The terminal in this Patent Document 1 is such that the direction of extension of a mating part having a contact component that comes into contact with terminals of a mating connector, is at a right angle to the direction of extension of a leg having at its lower end a connection component that is soldered to the circuit board, and the mating part and the leg are linked at an L-shaped bent part, forming an overall right-angle shape. The terminal having this right-angle shape is made as two types of terminals of different overall lengths. The bent part of the terminal with the shorter overall length is located to the inside of the bent part of the terminal with the longer overall length; the mating parts of the two terminals are arranged in parallel, as are the legs; the contact components of the two terminals are located in a front face opening of a housing; and the contact components of the two terminals are located on the lower face of the bottom wall of the housing.

The contact components of the terminals in Patent Document 1 have a pair (upper and lower) of integral elastic contact pieces that sandwich mating contact pins of the mating connector from above and below, and a throat section is formed by protrusions shaped so that local portions of both of the elastic contact pieces move closer together. This throat section is press-fitted so that pre-load rails of the housing push the throat section apart at both side positions in the width direction that is at a right angle to the insertion direction of the mating contact pins (the direction perpendicular to the paper plane in FIGS. 3 and 4 in Patent Document 1), and pre-loading in the direction of squeezing the pre-load rails is produced at the throat section as the reaction force of this. The mating contact pins are inserted into the throat section at the center position in the above-mentioned width direction, that is, between the pre-load rails in the width direction. Because these mating contact pins are larger in the vertical direction than the pre-load rails, the throat section is further widened, and the throat section comes into contact with the mating contact pins under contact pressure higher than the above-mentioned pre-loading.

The above-mentioned throat section is located such that the upper and lower contact points with the pre-load rails are offset to the front and rear, and the upper contact point is closer to the front face opening side than the lower contact point. Therefore, in a state prior to the insertion of the mating contact pins, a spreading force received from the pre-load rails acts as a force couple at the two contact points whose positions are offset in the longitudinal direction, and as a result, a moment that pushes the legs (and, in turn, the contact components) downward acts on the terminals.

With this Patent Document 1, even though the contact components of the two different (longer and shorter) terminals are in somewhat misaligned positions in the vertical direction with respect to the circuit board, the above-mentioned moment causes the contact components of the two different terminals to press on the circuit board, so as to align the positions with respect to the circuit board and avoid a solder connection defect.

PRIOR ART DOCUMENTS

Patent Document

Patent Document 1: U.S. Pat. No. 8,435,052

PROBLEMS TO BE SOLVED BY THE INVENTION

With Patent Document 1, when the connection components of two types of terminals are put into contact with a circuit board, even though they are in misaligned positions in the vertical direction with respect to the circuit board in a free state, the above-mentioned moment aligns their positions on the circuit board. Nevertheless, since this moment is always acting, reaction forces from the circuit board are exerted on the connection components of the two types of terminals, and these reaction forces are of different magnitude.

Furthermore, since the terminals are supported by pre-load rails at two contact points, even though the connection components receive the reaction force from the circuit board, they cannot move upward, nor can they rotate freely around these contact points, so this reaction force is absorbed by elastic deformation and remains in the connection components as stress, and the variance in this stress lingers between the types of terminals. The magnitude of this stress, and the variance thereof, can cause problems, namely, uneven soldering, incomplete soldering, and soldering defects when the connection components are soldered by automatic mounting to the corresponding circuit parts of the circuit board.

It is an object of the present invention to provide a right-angle electrical connector with which this problem is not encountered even when the positions of the connection components of different types of terminals are not aligned in the vertical direction with respect to the circuit board prior to mounting.

SUMMARY

The above problem is solved by the following first invention when the conductive bar members are held by an insulating board and are in the form of blades, and by a second invention in which the conductive bar members are held directly in a housing without the use of blades.

<First Invention>

A right-angle electrical connector pertaining to a first invention in which a plurality of conductive bar members are held side by side by an insulating board to form a type of blade, a mating part for insertion and removal of a mating connector is formed at the front part of a housing in the interior of which is formed a holding space for holding a plurality of types of blades of different lengths in the lengthwise direction of the conductive bar members, and a circuit board attachment face is provided on the bottom of the housing, having an angle that is perpendicular to said front face, the conductive bar members held on the insulating board by the various types of blades each have an arm that extends in a straight line in the insertion and removal direction and a leg that is linked via a bent part to the rear end of the arm and extends downward toward the bottom, and contact components for coming into contact with the corresponding terminals of a mating connector are formed at the front end of the arms, and contact components that are soldered to the corresponding circuit parts of the circuit board are formed at the lower end of the legs.

With such right-angle electrical connector, in this patent, the various types of blades are such that arm-use blades in which an arm is held and leg-use blades in which a leg is held are linked at the bent parts of the conductive bar members so that the blade planes form an angle, the plurality of types of blades are such that the lengths of the legs and the arms of the conductive bar members of the various types of blades are set so that the arm-use blades are successively positioned in the vertical direction and the leg-use blades in the longitudinal direction with spaces in between, the housing is such that holding grooves are formed that permit the arm-use blades of the various types of blades to be inserted from the rear, and connection components provided to the lower ends of the legs of the conductive bar members of the various types of blades are located outside the housing, the arm-use blades of the various types of blades are able to move in the vertical direction over a specific range within the corresponding holding grooves, and the various types of blades are able to move within the holding space.

With this configuration, various types of blades in the present invention are such that arm-use blades that extend in the mating direction of a mating connector are able to move in the vertical direction over a specific range within the holding grooves of the housing, that is, are able to move in the lengthwise direction of the legs of terminals extending at an angle to the plane of the circuit board. Therefore, when the connection components at the lower ends of the legs come into contact with the circuit board, misalignment in the height positions of the various types of blades is automatically corrected. As a result, no force is exerted that would leave behind stress after the position correction of the connection components, the soldering of the connection components to the circuit board is carried out properly, and no stress is produced at the soldered joints, so a good solder connection state is maintained.

In this invention, the arm-use blades are provided with latching protrusions at two locations separated in the longitudinal direction, two types of elastic latching tabs that latch the latching protrusions at the above-mentioned two locations are provided on the inner faces of holding grooves in the housing, and when the arm-use blades are inserted from the rear into the holding grooves, the elastic latching tabs are compressed by the arm-use blades and elastically deformed, which permits the insertion of the arm-use blades, and when the arm-use blades have been inserted to a specific position, the two types of elastic latching tabs are positioned between the two latching protrusions, one of the two types of elastic latching tabs is latched with the rear latching tab to restrict forward movement of the arm-use blades, and the other elastic latching tab latches with the forward latching tab to restrict rearward movement of the arm-use blades.

As a result of this, when the blades are put into the housing, during insertion of the arm-use blade into the holding grooves, the elastic latching tabs are compressed by the arm-use blades and elastically deformed, which permits the insertion of the arm-use blades, and when the insertion is complete, two elastic latching tabs are released from their state of elastic deformation, and latch in the longitudinal direction with the latching protrusions of the corresponding arm-use blades, which positions the blades and prevents them from coming loose.

In this invention, it is preferable that the arm-use blades are provided with restricting protrusions that prevent contact over the entire length of the arm-use blades with the inner faces of the holding grooves when the arm-use blades have moved in the vertical direction within the holding grooves. As a result of this, when the connection components and the circuit board come into contact, the arm-use blades receive the contact force from the circuit board or receive an elastic force from the elastic latching tabs, so even if the arm-use blades move so that the opposite side from the face that receives the above-mentioned contact force or the above-mentioned elastic force moves closer to the inner faces of the holding grooves, only the restricting protrusions provided to the arm-use blades will come into contact with the inner faces of the holding grooves, so there is less frictional force with the holding grooves, and even if movement of the arm-use blades in the vertical direction is accompanied by movement in the longitudinal direction, this movement will not be hindered whatsoever.

In this invention, it is preferable that the arm-use blades are such that an insulating coating is given to the arms in a proximity range that minimizes the gap between the arms of the conductive bar members and the elastic latching tabs of the housing. When a right-angle electrical connector is used for high-speed signal transmission, even if the arm-use blades move in the vertical direction within the holding grooves with a freedom of movement in the above-mentioned positional correction of the connection components, since the terminals have been given an insulating coating in a proximity range that minimizes the gap from the elastic latching tabs of the housing in the vertical direction, even the above-mentioned positional correction of the connection components is attended by fluctuation in the above-mentioned gap, there will be no attendant fluctuation in the distance from the insulator, so the characteristics will not be diminished during high-speed signal transmission in the conductive bar members.

<Second Invention>

A right-angle electrical connector pertaining to a second invention in which a plurality of types of conductive bar members of different lengths are held in a holding space of a housing, and said conductive bar members each have an arm that extends in a straight line in the insertion and removal direction and a leg that is linked via a bent part to the rear end of the arm and extends downward toward the bottom, and contact components for coming into contact with the corresponding terminals of a mating connector are formed at the front end of the arms, and contact components that are soldered to the corresponding circuit parts of the circuit board are formed at the lower end of the legs.

With such a right-angle electrical connector, in this invention, the plurality of types of conductive bar members are such that the lengths of the legs and the arms are set so that the arms are successively positioned in the vertical direction and the legs in the longitudinal direction with spaces in between, the housing is such that holding grooves are formed that permit the arms of the various types of conductive bar members to be inserted from the rear, and connection components provided to the lower ends of the legs of the various types of conductive bar members are located outside the housing, the arms of the various types of conductive bar members are able to move in the vertical direction over a specific range within the corresponding holding grooves, and the various types of conductive bar members are able to move within the holding space.

With the right-angle electrical connector of the present invention configured as above, just as when there are blades as discussed above, the conductive bar members will be able to move in the vertical direction within the holding grooves, so even if the conductive bar members move within the holding grooves in the positional correction of the connection components, no stress will remain at the soldered joints between the connection components and the circuit board.

Effects of the Invention

As discussed above, with the present invention, there are arm-use blades and leg-use blades in a positional relation in which a plurality of blades held in a holding space of a housing are at an angle, and by the arm-use blades holding the arms of conductive bar members and the leg-use blades holding the legs of the conductive bar members, the arm-use blades and the leg-use blades are linked at bent parts of the conductive bar members, and the arm-use blades extending in the mating direction of a mating connector are held movably in the vertical direction within holding grooves, so even if the connection components provided to the lower end of the legs of blades extending downward are in misaligned positions in the vertical direction prior to the mounting of the connector to the circuit board, these connection components will move so that they can be freely lifted up during mounting and their positions will be corrected so as to be aligned on the circuit board plane, so that good soldering can be achieved, without any stress being caused by movement of the connection components when soldering during mounting.

Also, even if the conductive members are not in a form in which they are held by an insulating board, if they are held directly in the holding space of the housing, the arms of the conductive bar members will be able to move in the vertical direction within the holding grooves such that, in the positional correction of the connection components, they will be soldered to the circuit board without producing any stress.

BRIEF DESCRIPTION OF THE DRAWINGS

FIG. 6B is a bottom view of part of the lower face of the arm-use blade in FIG. 4, and FIG. 6C is a VI-VI cross section of (A).

DETAILED DESCRIPTION

An embodiment of the present invention will now be described through reference to the appended Drawings.

Figure 1B:
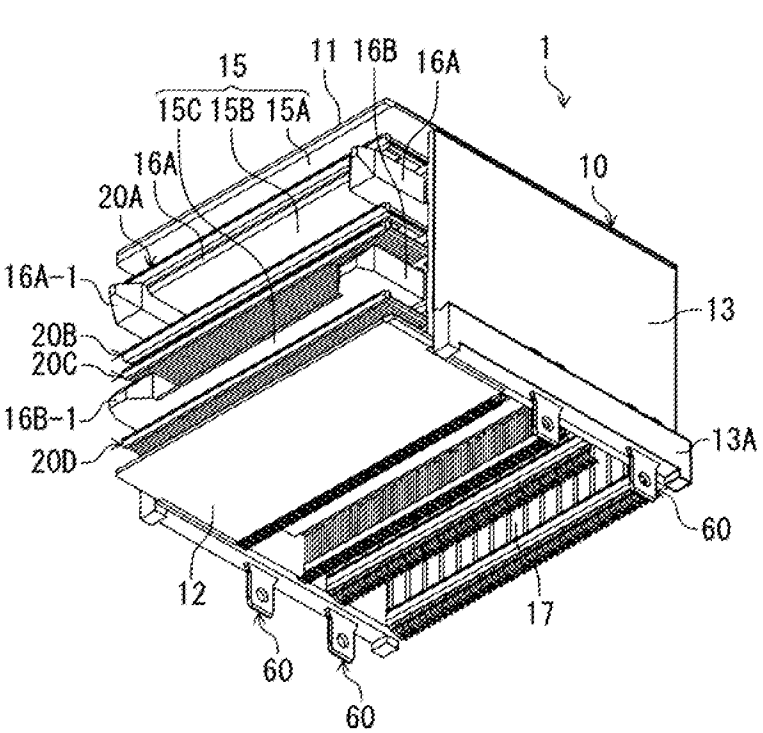
FIGS. 1A and 1B Oblique views of the connector pertaining to an embodiment of the present invention, with FIG. 1A being a diagonally upward view and FIG. 1B a diagonally downward view.
Figure 1A:
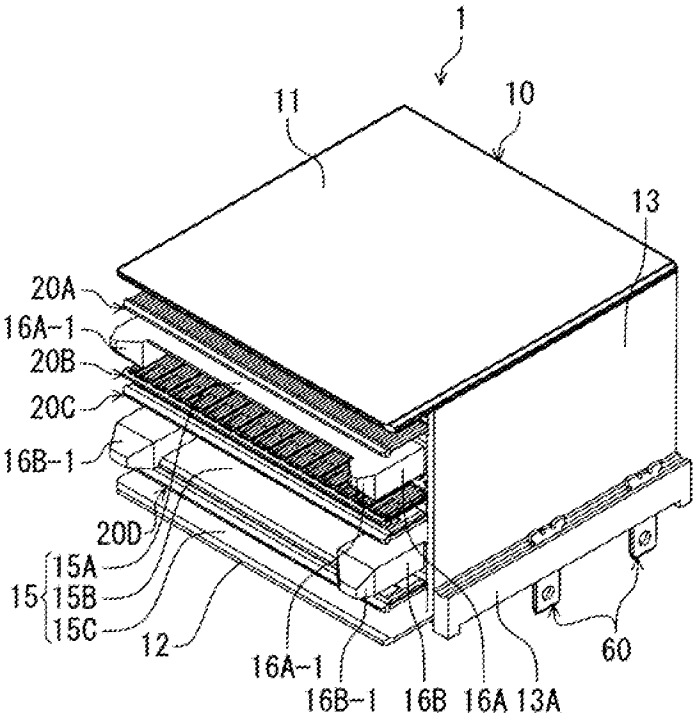
Figure 2:
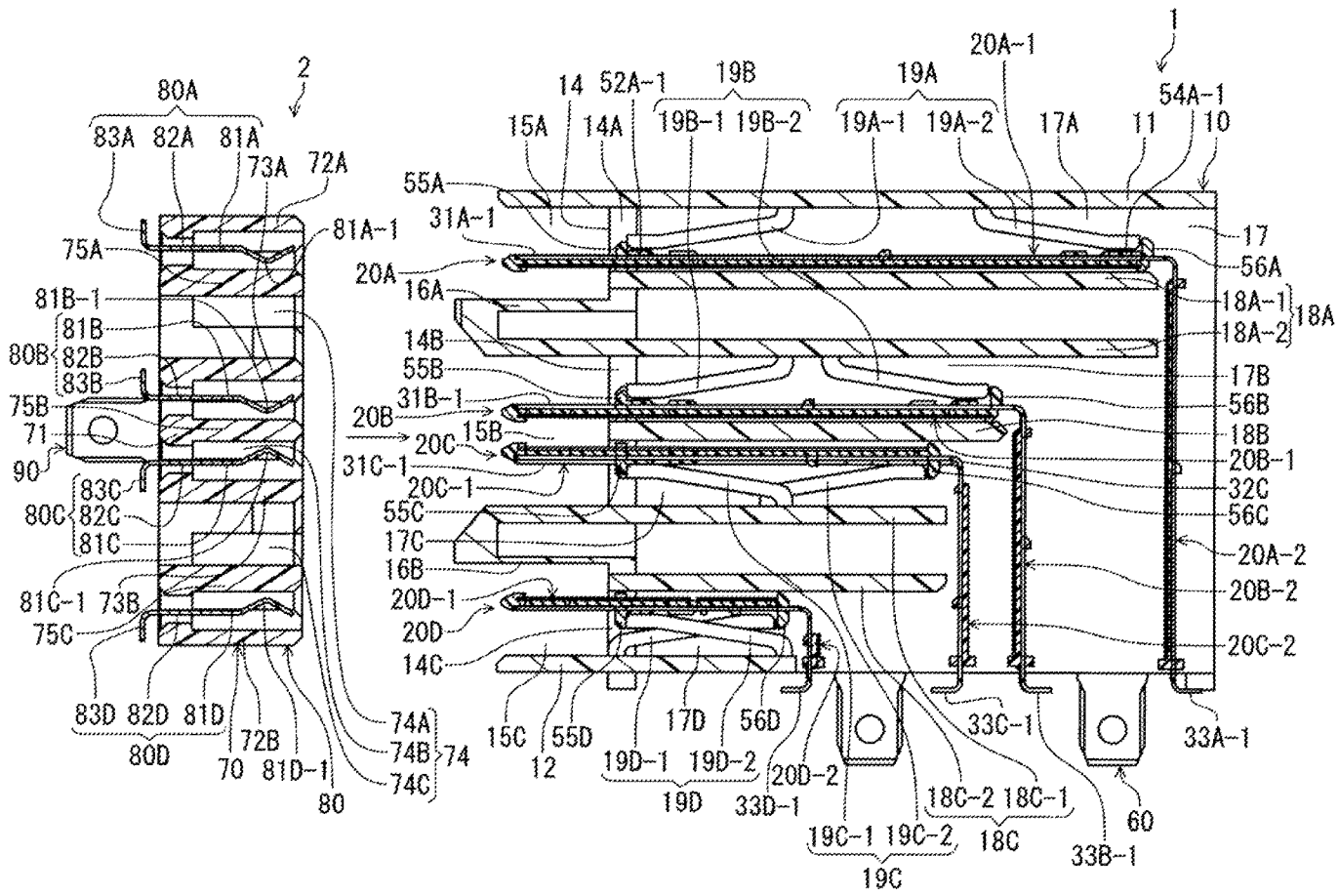
FIG. 2 A cross section of the connector in FIG. 1 in a plane that is perpendicular to the connector width direction, in which a cross section of the positions of the terminals in the connector width direction is shown along with a cross section of a mating connector.

The electrical connector of this embodiment shown in FIGS. 1A and 1B is a so-called right-angle electrical connector (hereinafter referred to simply as a "connector") in which the direction in which the mating connector is fitted is at a right angle to the direction in which the connection components soldered to a circuit board (not shown) are disposed on this circuit board, that is, the direction of extension of the legs of the terminals on which the connection components are formed. FIG. 1A is an oblique view of the connector 1 pertaining to this embodiment as seen diagonally upward and FIG. 1B is of this connector 1 as seen diagonally downward. FIG. 2 is a cross section of the connector 1 in a plane that is perpendicular to the connector width direction, in which a cross section of the positions of the terminals in the connector width direction is shown along with a cross section of a mating connector. In FIG. 2, hatching is omitted from the cross section of the terminals and the cross section of a shield plate.

The connector 1 has a housing 10 made from an electrically insulating material and substantially in cuboid form, four types of blades 20A, 20B, 20C, and 20D that are housed in the housing 10, and an attachment member 60 for attaching and fixing the housing 10 to the circuit board.

As shown in FIGS. 1A and 1B, the housing 10 has a top wall 11, a bottom wall 12, and a side wall 13 that links the side ends of these two walls. The top wall 11 and the bottom wall 12 protrude forward (to the left in the drawing) beyond the side wall 13, and as seen in FIG. 2, a front wall 14 is provided at the front end position of the side wall 13. The space formed between the top wall 11 and the bottom wall 12 in front of the front wall 14 serves as a receptacle 15 for receiving a mating connector 2. Upper protruding walls 16A and lower protruding walls 16B that extend forward beyond the front wall 14 are provided inside the receptacle 15. The upper protruding walls 16A and the lower protruding walls 16B are formed by having tapered guide protrusions 16A-1 and 16B-1 that protrude forward at both ends in the connector width direction (a direction that is perpendicular to both the longitudinal direction and the vertical direction). In the course of the connector mating, the guide protrusions 16A-1 and 16B-1 serve to guide the mating part of the mating connector 2 into the receptacle 15.

The receptacle 15 is divided by the upper protruding walls 16A and the lower protruding walls 16B into three spaces in the vertical direction: an upper receptacle 15A, a middle receptacle 15B, and a lower receptacle 15C. The front end portions of a first blade 20A, a second blade 20B, a third blade 20C, and a fourth blade 20D (discussed below) that are held in the housing 10 are located in the upper receptacle 15A, the middle receptacle 15B, and the lower receptacle 15C.

As shown in FIG. 2, an upper opening 14A, a middle opening 14B, and a lower opening 14C that pass through in the longitudinal direction (the wall thickness direction of the front wall 14) are formed in the front wall 14 at positions corresponding to the upper receptacle 15A, the middle receptacle 15B, and the lower receptacle 15C, respectively.

As shown in FIGS. 1A and 1B, an attachment component 13A that protrudes outward in the connector width direction and extends longitudinally is provided to the lower part of the side wall 13 of the housing 10. Attachment members 60 made of metal plates are provided to the attachment component 13A, protruding downward beyond the bottom wall 12.

As shown in FIG. 2, the housing 10 has a holding space 17 for holding the blades 20A to 20D, formed on the back part (rear part) beyond the front wall 14. The holding space 17 is open to the front and communicates with the upper receptacle 15A, the middle receptacle 15B, and the lower receptacle 15C via the upper opening 14A, the middle opening 14B, and the lower opening 14C, respectively, of the front wall 14. Furthermore, as shown in FIG. 2, the holding space 17 is open to the rear, and is also open downward over the rear half of the housing 10.

As shown in FIG. 2, the housing 10 has an upper partition 18A, a middle partition 18B, and a lower partition 18C provided in that order within the holding space 17. This holding space 17 comprises a first holding groove 17A between the top wall 11 and the upper partition 18A, a second holding groove 17B between the upper partition 18A and the middle partition 18B, a third holding groove 17C between the middle partition 18B and the lower partition 18C, and a fourth holding groove 17D between the lower partition 18C and the bottom wall 12. As shown in FIG. 2, arm-use blades 20A-1 to 20D-1 (discussed below) of the respective blades 20A to 20D are held in each of the corresponding holding grooves 17A to 17D.

The upper partition 18A has an upper top partition 18A-1 and an upper bottom partition 18A-2 located above and below. The upper top partition 18A-1 extends rearward from the rear face of the front wall 14 at a position above the upper protruding walls 16A, and the upper bottom partition 18A-2 extends rearward from the rear face of the front wall 14 at the same height as the lower part of the upper protruding walls 16A. The upper top partition 18A-1 and the upper bottom partition 18A-2 extend to near the rear end of the housing 10.

The middle partition 18B extends rearward from the rear face of the front wall 14 at a center position of the front wall 14 in the vertical direction, as a single wall component. The middle partition 18B is shorter than the upper partition 18A, that is, its rear end is positioned ahead of the rear end of the upper partition 18A.

The lower partition 18C has a lower top partition 18C-1 and a lower bottom partition 18C-2 located above and below. The lower top partition 18C-1 extends rearward from the rear face of the front wall 14 at the same height position as the upper part of the lower protruding walls 16B. The lower bottom partition 18C-2 extends rearward from the rear face of the front wall 14 at a position lower than the lower part of the lower protruding walls 16B. The lower top partition 18C-1 and the lower bottom partition 18C-2 are shorter than the middle partition 18B, that is, their rear ends are positioned ahead of the rear end of the middle partition 18B.

As shown in FIG. 2, the housing 10 is provided with a plurality of elastic latching tabs 19A to 19D for restricting the movement of the blades 20A to 20D, respectively, in the longitudinal direction. The elastic latching tabs 19A to 19D are provided in a cantilevered form that can be elastically deformed in the vertical direction within the holding grooves 17A to 17D, respectively, and restrict the movement of the blades 20A to 20D in the longitudinal direction. In this embodiment, the elastic latching tabs consist of a plurality of first elastic latching tabs 19A that extend from the lower face of the top wall 11 within the first holding groove 17A and restrict the movement of the first blade 20A, a plurality of second elastic latching tabs 19B that extend from the lower face of the upper bottom partition 18A-2 and restrict the movement of the second blade 20B, a plurality of third elastic latching tabs 19C that extend from the upper face of the lower top partition 18C-1 and restrict the movement of the third blade 20C, and a plurality of fourth elastic latching tabs 19D that extend from the upper face of the bottom wall 12 and restrict the movement of the fourth blade 20D.

Figure 3A:
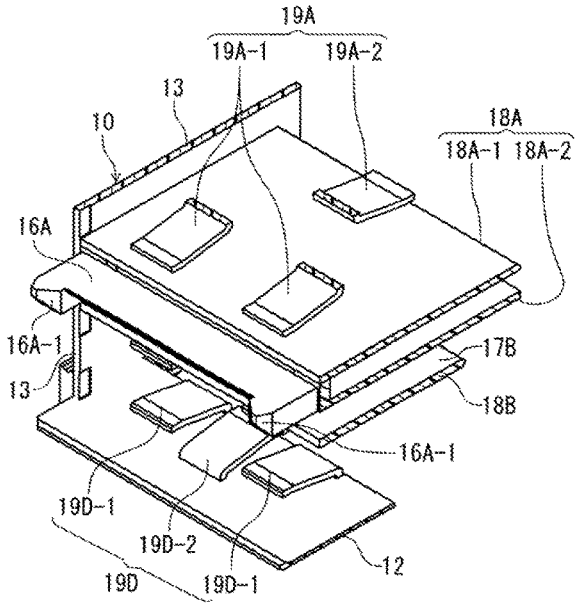
FIGS. 3A and 3B Oblique views of part of the housing of the connector in FIG. 1, with FIG. 3A being a diagonally upward view and FIG. 3B a diagonally downward view.
Figure 3B:
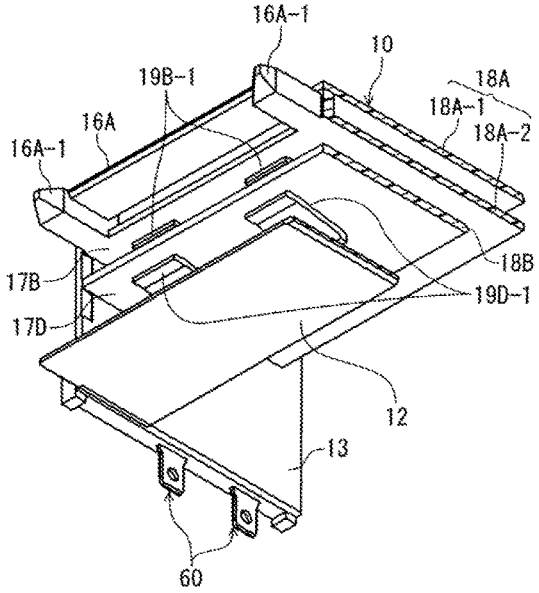

FIG. 3A is an oblique view of part of the housing 10 of the connector 1 as seen from diagonally above, and FIG. 3B is as seen from diagonally below. The top wall 11 of the housing 10, the side wall 13 on the front side, the lower protruding walls 16B, the lower partition 18C, and the third elastic latching tabs 19C are not shown in FIGS. 3A and 3B.

As shown in FIGS. 2 and 3A, the first elastic latching tabs 19A have two first forward latching tabs 19A-1 that extend toward the front to the position of the front wall 14 at a position nearer the front end of the top wall 11, and one first rearward latching tab 19A-2 that extends toward the rear to near the rear end position of the upper top partition 18A-1 at a position nearer the rear end of the top wall 11. As shown in FIG. 2, the first forward latching tabs 19A-1 and the first rearward latching tab 19A-2 are provided spaced apart in the longitudinal direction, without having any range where they overlap each other. Also, as shown in FIG. 3A, in the connector width direction, the first rearward latching tab 19A-2 is provided at a position between the two first forward latching tabs 19A-1.

The second elastic latching tabs 19B have two second forward latching tabs 19B-1 that extend toward the front to the position of the front wall 14 at an intermediate position in the longitudinal direction of the upper bottom partition 18A-2, and one second rearward latching tab 19B-2 that extends toward the rear to near the rear end position of the middle partition 18B at a position further to the rear than the second forward latching tabs 19B-1. As shown in FIG. 2, the second forward latching tabs 19B-1 and the second rearward latching tab 19B-2 are provided spaced apart in the longitudinal direction without having any range where they overlap each other. Also, in the connector width direction, the second rearward latching tab 19B-2 is provided between the two second forward latching tabs 19B-1.

As shown in FIG. 2, the third elastic latching tabs 19C have two third forward latching tabs 19C-1 that extend toward the front to the position of the front wall 14 at an intermediate position in the longitudinal direction of the lower top partition 18C-1, and one third rearward latching tab 19C-2 that extends toward the rear to near the rear end position of the lower top partition 18C-1 at a position further to the rear than the third forward latching tabs 19C-1. As shown in FIG. 2, the third forward latching tabs 19C-1 and the third rearward latching tab 19C-2 are positioned so to have a range in which their bases overlap each other in the longitudinal direction. Also, in the connector width direction, the third rearward latching tab 19C-2 is provided between the two third forward latching tabs 19C-1.

As shown in FIGS. 2 and 3A, the fourth elastic latching tabs 19D have two fourth forward latching tabs 19D-1 that extend toward the front to the position of the front wall 14 from the rear end position of the bottom wall 12, and one fourth rearward latching tab 19D-2 that extends toward the rear to the rear end position of the bottom wall 12 from the position of the front wall 14. As shown in FIG. 2, the fourth forward latching tabs 19D-1 and the fourth rearward latching tab 19D-2 are positioned so to have a range in which their portions other than the bases overlap each other in the longitudinal direction. Also, as shown in FIG. 3A, in the connector width direction, the fourth rearward latching tab 19D-2 is provided at a position between the two fourth forward latching tabs 19D-1.

The four types of blades 20A to 20D are made by holding a plurality of terminals in parallel with insulating boards. These four types of blades 20A to 20D differ in the lengths of their insulating boards and terminals, but share their basic configuration. The configuration of the first blade 20A will be described first, and the configuration of the second blade 20B, the third blade 20C, and the fourth blade 20D will be described by focusing on what is different from the other blades.

Figure 4:
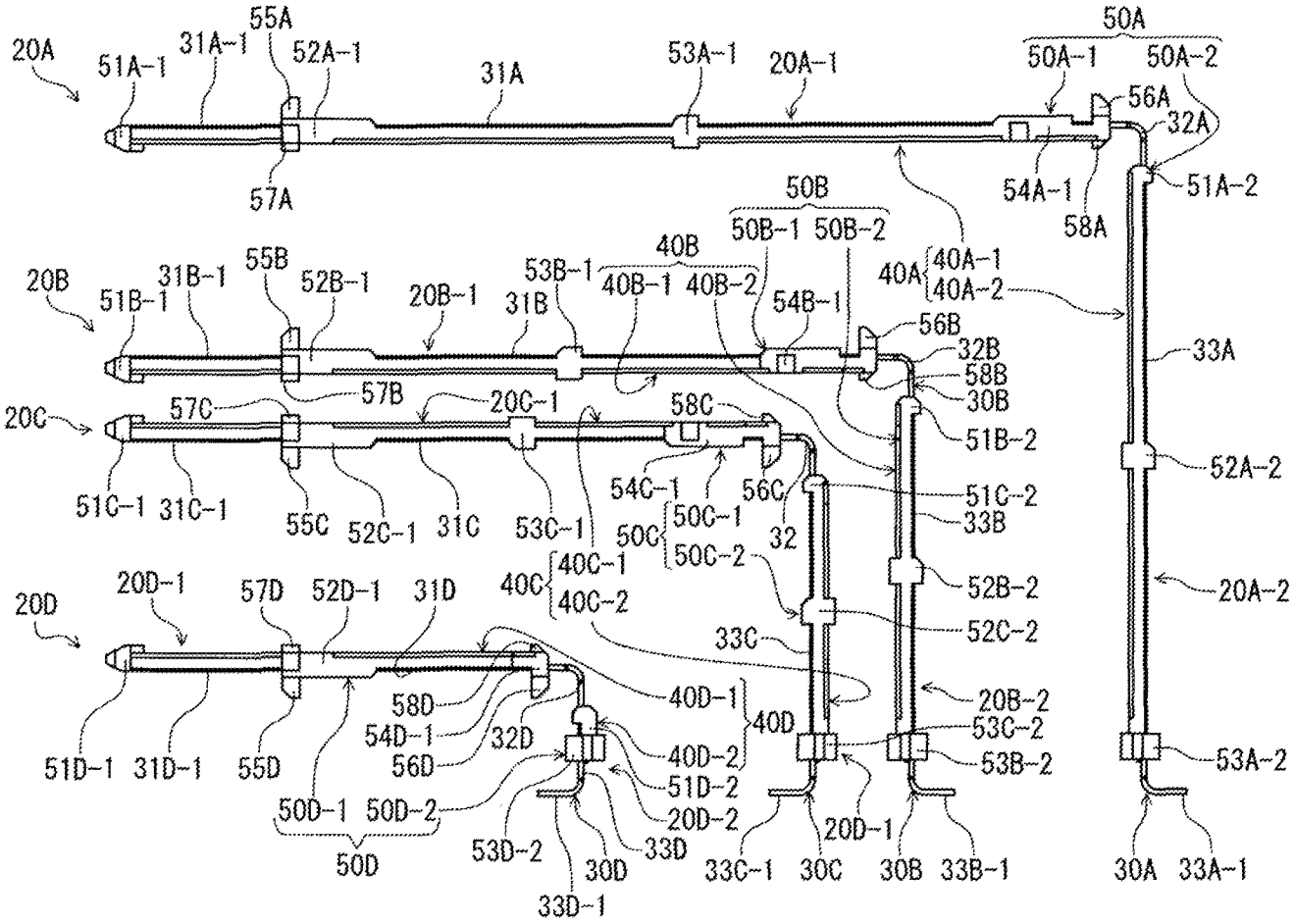
FIG. 4 is a side view of only the various types of blades of the connector in FIGS. 1A and 1B.
Figure 5B:
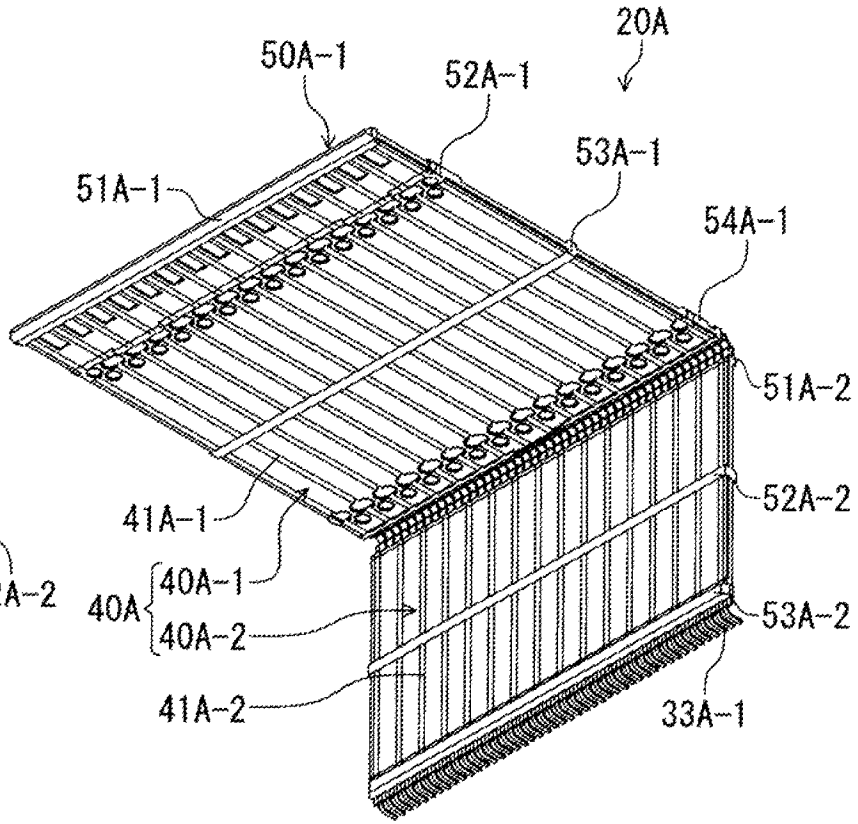
FIGS. 5A and 5B Oblique views of a first blade of the connector shown in FIG. 1, with FIG. 5A being a diagonally upward view and FIG. 5B a diagonally downward view.
Figure 5A:
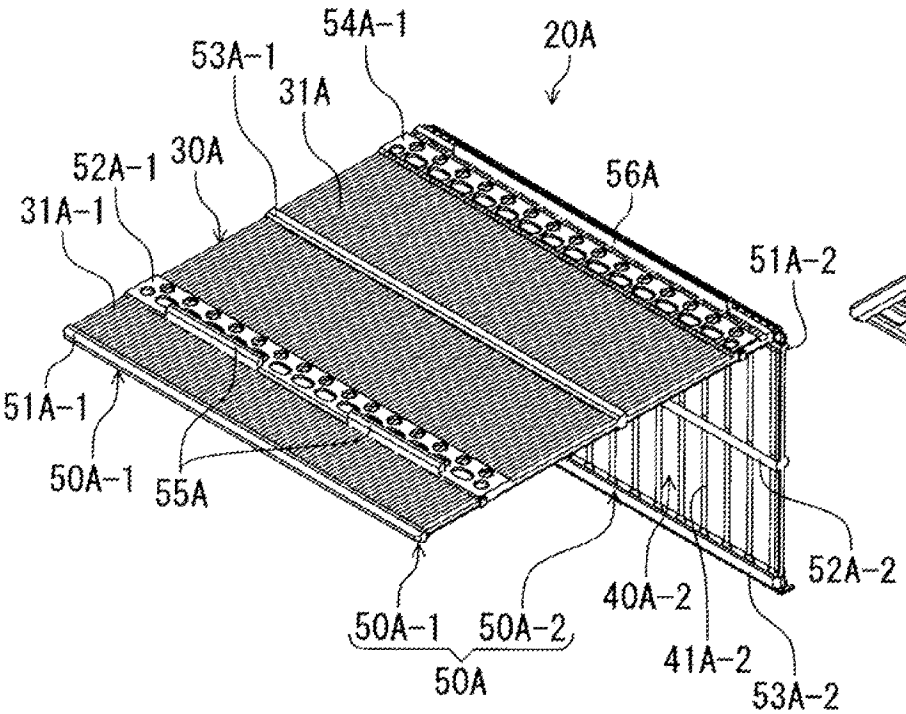
Figures 6A, 6B, 6C:
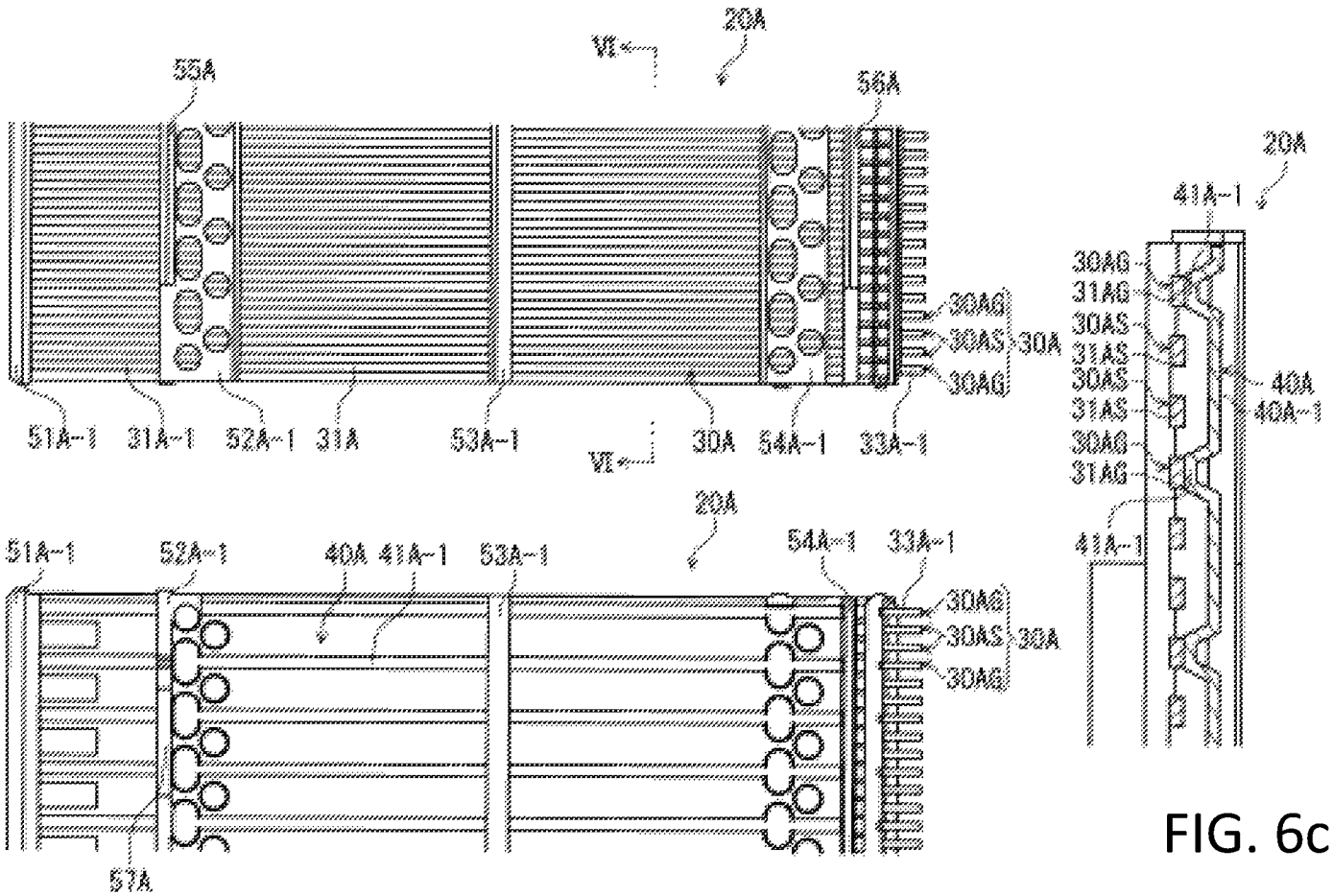
FIGS. 6A-6C A plan view of part of the upper face of part of the arm-use blade in FIG. 4.

FIG. 4 is a side view of the blades 20A to 20D. FIG. 5 is an oblique view of the first blade 20A, with FIG. 5A being as seen from diagonally above, and FIG. 5B from diagonally below. FIG. 6A is a plan view of part of the upper face of the arm-use blade 20A-1 of the first blade 20A, FIG. 6B is a bottom view of part of the lower face of the arm-use blade 20A-1, and FIG. 6C is a VI-VI cross section of FIG. 6A, showing a cross section along a plane perpendicular to the longitudinal direction of part of the arm-use blade 20A-1.

The first blade 20A has terminals 30A in the form of a plurality of conductive bar members arranged in the connector width direction, a shield plate 40A provided so as to cover the range over which the terminals are arranged, and an insulating board 50A that holds the terminals 30A and the shield plate 40A by integrated molding.

All of the terminals 30A are made in the same shape, but some of the terminals 30A are used as signal terminals 30AS, and the rest of the terminals 30A as ground terminals 30AG. More specifically, as shown in FIGS. 6A to 6C, the terminals 30A are arranged in a repeating pattern in the order of "ground terminal 30AG, signal terminal 30AS, signal terminal 30AS" in the connector width direction, and one ground terminal 30AG is located on either side of a pair of adjacent signal terminals 30AS.

As discussed above, the signal terminals 30AS and the ground terminals 30AG have the same shape, so they will collectively be described here as the "terminals 30A" without distinguishing between the two. Where needed, an "S" will be added to the signal terminal (30AS), and a "G" to the ground terminal (30AG).

The terminals 30A are made by bending a metal strip in the plate thickness direction and, as shown in FIG. 4, have an arm 31A that extends in a straight line in the longitudinal direction (the connector insertion and removal direction), a bent part 32A that is bent downward at a right angle at the rear end of the arm 31A, and a leg 33A that is linked to the arm 31A via this bent part 32A and extends downward toward the bottom of the housing 10.

As shown in FIG. 4, the arm 31A extends in the longitudinal direction along the upper face of an arm-use insulating board 50A-1 (discussed below), and the majority of the upper face (plate surface) of the arm 31A is exposed from the upper face of the arm-use insulating board 50A-1 as shown in FIGS. 5A and 6A. The upper face (exposed face) of the front end portion of the arm 31A is formed as a contact component 31A-1 that comes into contact with mating terminals (corresponding terminals) 80 provided to the mating connector 2 (see FIG. 2).

As shown in FIG. 4, the leg 33A extends in the vertical direction along the rear face (the right face in FIG. 4) of a leg-use insulating board 50A-2 (discussed below), and the majority of the rear face (plate surface) of the leg 33A is exposed from the rear face of the leg-use insulating board 50A-2. The lower end of the leg 33A is bent at a right angle and extends toward the rear, and is formed as a connection component 33A-1 that is soldered to the corresponding circuit part of the circuit board (not shown).

As shown in FIG. 4, the shield plates 40A have an arm-use shield plate 40A-1 provided corresponding to the arm 31A of the terminal 30A, and a leg-use shield plate 40A-2 provided corresponding to the leg 33A of the terminal 30A. The arm-use shield plate 40A-1 is provided along the lower face of the arm-use insulating board 50A-1 (discussed below), extends over substantially the entire length of the arm 31A in the longitudinal direction, and as shown in FIG. 5B extends over the entire range in which the terminals are arranged in the connector width direction (terminal layout direction).

As shown in FIG. 6C, the arm-use shield plate 40A-1 protrudes upward (to the left in FIG. 6C), that is, to the arm 31AG side, at a position corresponding to the arm 31AG of a ground terminal 30AG in the connector width direction, and an arm-use projection 41A-1 is formed extending over the entire arm-use shield plate 40A-1 in the longitudinal direction. The protruding top face of the arm-use projection 41A-1 is in contact with the lower face (the right face in FIG. 6C) of the arm 31AG, allowing electrical connection with a ground terminal 30AG.

As shown in FIG. 4, the leg-use shield plate 40A-2 is provided along the front face (the left face in FIG. 4) of the leg-use insulating board 50A-2 (discussed below), extends over substantially the entire length of the leg 33A in the vertical direction, and as shown in FIG. 5B extends over the entire range in which the terminals are arranged in the connector width direction (terminal layout direction). The leg-use shield plate 40A-2 protrudes rearward, that is, to the leg 33AG side, at a position corresponding to the leg 33AG of a ground terminal 30AG in the connector width direction, and a leg-use projection 41A-2 is formed extending over the entire leg-use shield plate 40A-2 in the vertical direction (see FIGS. 5A and 5B). The protruding top face of the leg-use projection 41A-2 is in contact with the front face of the leg 33AG, allowing electrical connection with a ground terminal 30AG.

As shown in FIG. 4, the insulating board 50A has the arm-use insulating board 50A-1 provided corresponding to the arm 31A of the terminal 30A, and a leg-use insulating board 50A-2 provided corresponding to the leg 33A of the terminal 30A.

The arm-use insulating board 50A-1 is a flat member made of resin, and as shown in FIG. 4, extends over substantially the entire length of the arm 31A in the longitudinal direction, and extends over the entire range in which the terminals are arranged in the connector width direction (terminal layout direction). The arm-use insulating board 50A-1 has formed on its upper and lower faces holders 51A-1 to 54A-1 that extend over the entire connector width direction at four positions in the longitudinal direction (see FIGS. 5A and 5B). More specifically, a front end holder 51A-1 is formed at the front end position of the arm-use insulating board 50A-1, a forward intermediate holder 52A-1 at a forward intermediate position, a rearward intermediate holder 53A-1 at a rearward intermediate position, and a rear end holder 54A-1 at the rear end position. These holders 51A-1 to 54A-1 cover the upper faces of the arms 31A of the terminals 30A and the lower face of the arm-use shield plate 40A-1, and consequently the arms 31A and the arm-use shield plate 40A-1 are more securely held by the arm-use insulating board 50A-1.

As shown in FIG. 2, in this embodiment, the forward intermediate holder 52A-1 is positioned corresponding to the front ends of the first forward latching tabs 19A-1 in the longitudinal direction, and the rear end holder 54A-1 is positioned corresponding to the rear end of the first rearward latching tab 19A-2 in the longitudinal direction. In other words, the holders 52A-1 and 54A-1 give an insulating coating by covering the upper face of the arm 31AS over a proximity range that minimizes the gap between the elastic latching tabs 19A-1 and 19A-2 and the arms 31AS of the signal terminals 30AS. As a result, when the connector 1 is used for high-speed signal transmission connector, for example, even if the arm-use blade 20A-1 moves in the vertical direction within the first holding groove 17A, as discussed below, and fluctuation in said gap occurs, there will be no attendant fluctuation in the distance from the insulator, so the characteristics will not be diminished during high-speed signal transmission in the signal terminals 30AS.

Also, as shown in FIG. 4, the arm-use insulating board 50A-1 has two forward latching protrusions 55A that protrude upward from the upper face of the forward intermediate holder 52A-1 and extend in the connector width direction, and one rearward latching protrusion 56A that protrudes upward from the upper face of the rear end holder 54A-1 and extends in the connector width direction (see FIG. 5A as well). As shown in FIG. 5A, the two forward latching protrusions 55A are formed at positions corresponding to the two first forward latching tabs 19A-1 (see FIG. 3A) of the housing 10 in the connector width direction. As shown in FIG. 5A, the rearward latching protrusion 56A is formed over the majority of the intermediate area in the connector width direction of the rear end holder 54A-1 (the region excluding the two end areas), and is positioned to correspond to the first rearward latching tab 19A-2 (see FIG. 3A) of the housing 10 in the connector width direction.

As discussed below, when the forward latching protrusions 55A latch the front ends of the first forward latching tabs 19A-1, this restricts rearward movement of the arm-use blade 20A-1, and in turn the first blade 20A, to no more than a specific amount (see FIG. 2). Also, when the rearward latching protrusion 56A latches the rear end of the first rearward latching tab 19A-2, this restricts forward movement of the arm-use blade 20A-1, and in turn, the first blade 20A, to no more than a specific amount (see FIG. 2). In this embodiment, the distance between the latching protrusions 55A and 56A in the longitudinal direction is set to be somewhat greater than the distance between the distal ends (free ends) of the elastic latching tabs 19A-1 and 19A-2 in the longitudinal direction. That is, there is a gap (looseness) between the latching protrusions 55A and 56A and the elastic latching tabs 19A-1 and 19A-2 in the longitudinal direction, and it is possible for the arm-use blade 20A-1, and in turn the first blade 20A, to move in the longitudinal direction with freedom of movement within the range of this gap.

Also, the arm-use insulating board 50A-1 has two forward restricting protrusions 57A that protrude downward from the lower face of the forward intermediate holder 52A-1 and extend in the connector width direction, and one rearward restricting protrusion 58A that protrudes downward from the lower face of the rear end holder 54A-1 and extends in the connector width direction. The arm-use blade 20A-1 comes into contact with only these restricting protrusions 57A and 58A with respect to the upper face of the upper top partition 18A-1 (see FIG. 2), and consequently the arm-use blade 20A-1 is prevented from coming into contact with the upper face of the upper top partition 18A-1 over the entire length in the longitudinal direction. As a result, as will be discussed below, when the arm-use blade 20A-1 moves obliquely within the first holding groove 17A, even if this is accompanied by movement in the longitudinal direction, there will be little friction between the arm-use blade 20A-1 and the upper face of the upper top partition 18A-1, so this movement will not be hindered whatsoever.

The leg-use insulating board 50A-2 is a flat member made of resin, and as shown in FIG. 4, extends over substantially the entire length of the leg 33A in the vertical direction, and extends over the entire range in which the terminals are arranged in the connector width direction (terminal layout direction). The holders 51A-2 to 53A-2, which extend over the entire region in the connector width direction, are formed at three positions in the vertical direction on the front and rear faces of the leg-use insulating board 50A-2. More specifically, an upper end holder 51A-2 is formed at the upper end position of the leg-use insulating board 50A-2, an intermediate holder 52A-2 at an intermediate position, and a lower end holder 53A-2 at the lower end position. These holders 51A-2 to 53A-2 cover the rear faces of the legs 33A of the terminals 30A and the front face of the leg-use shield plate 40A-2, and consequently the legs 33A and the leg-use shield plate 40A-2 are held more securely by the leg-use insulating board 50A-2.

The first blade 20A is such that the arm-use shield plate 40A-1 and the arms 31A of a plurality of terminals 30A are held by the arm-use insulating board 50A-1, and the leg-use shield plate 40A-2 and the legs 33A of a plurality of the terminals 30A are held by the leg-use insulating board 50A-2, both by integral molding. The first blade 20A made in this manner is configured such that the arm-use blade 20A-1 having the arm-use insulating board 50A-1, the arm-use shield plate 40A-1, and the arms 31A, forms a right angle with the leg-use blade 20A-2 having the leg-use insulating board 50A-2, the leg-use shield plate 40A-2, and the legs 33A, and these blades are linked at the bent parts 32A of the terminals 30A.

The second blade 20B is formed such that the arm-use blade 20A-1 of the first blade 20A is shortened in the longitudinal direction, and the leg-use blade 20A-2 is shortened in the vertical direction. In other words, the arms 31B and legs 33B of the terminals 30B of the second blade 20B, the shield plates 40B-1 and 40B-2, and the insulating boards 50B-1 and 50B-2 are shorter than the arms 31A and legs 33A of the terminals 30A of the first blade 20A, the shield plates 40A-1 and 40A-2, and the insulating boards 50A-1 and 50A-2.

The third blade 20C is formed such that the arm-use blade 20B-1 of the second blade 20B is shortened in the longitudinal direction, and the leg-use blade 20B-2 is shortened in the vertical direction. In other words, the arms 31C and legs 33C of the terminals 30C of the third blade 20C, the shield plates 40C-1 and 40C-2, and the insulating boards 50C-1 and 50C-2 are shorter than the arms 31B and legs 33B of the terminals 30B of the second blade 20B, the shield plates 40B-1 and 40B-2, and the insulating boards 50B-1 and 50B-2. Also, the third blade 20C differs from the second blade 20B in that the connection components 33C-1 of the terminals 30C extend toward the front, the latching protrusions 55C and 56C of the arm-use insulating board 50C-1 protrude downward, and the restricting protrusions 57C and 58C of the arm-use insulating board 50C-1 protrude upward.

The fourth blade 20D is formed such that the arm-use blade 20C-1 of the third blade 20C is shortened in the longitudinal direction, and the leg-use blade 20C-2 is shortened in the vertical direction. In other words, the arms 31D and legs 33D of the terminals 30D of the fourth blade 20D, the shield plates 40D-1 and 40D-2, and the insulating boards 50D-1 and 50D-2 are shorter than the arms 31C and legs 33C of the terminals 30C of the third blade 20C, the shield plates 40C-1 and 40C-2, and the insulating boards 50C-1 and 50C-2.

Figure 7:
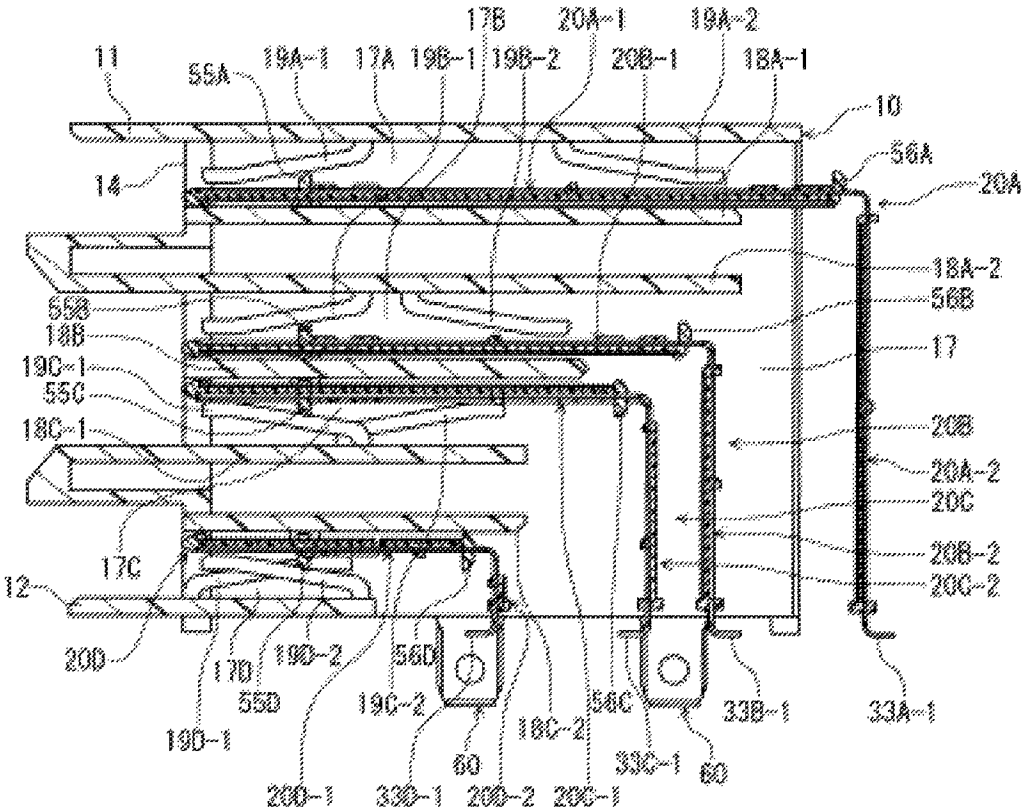
FIG. 7 A cross section of a connector along a plane perpendicular to the connector width direction, and shows the state of the process of attaching blades to the housing as a cross section of the position of the terminals in the connector width direction.

The assembly of the connector 1 will now be described. The connector 1 is assembled by attaching the four types of blades 20A to 20D to the housing 10 in the order, from the rear, of the fourth blade 20D, the third blade 20C, the second blade 20B, and the first blade 20A. FIG. 7 is a cross section of the connector 1 along a plane perpendicular to the connector width direction, and shows the state in the course of attaching the blades 20A to 20D to the housing 10 as a cross section at the positions of the terminals 30A to 30D in the connector width direction. In FIG. 7, hatching is omitted from the cross section of the terminals 30A to 30D and the cross section of the shield plates 40A to 40D.

First, the attachment members 60 are attached to the attachment component 13A of the housing 10 by press-fitting from above. The attachment of the attachment members 60 may be performed after the attachment of the blades 20A to 20D, or at the same time. Also, the attachment members 60 may be attached by press-fitting from below, or may be attached by integral molding with the housing 10.

Next, the arm-use blade 20D-1 of the fourth blade 20D is moved forward along the lower face of the lower bottom partition 18C-2 of the housing 10, and inserted into the fourth holding groove 17D. In the course of this insertion, the forward latching protrusions 55D of the arm-use blade 20D-1 come into contact with the fourth rearward latching tab 19D-2, and elastically deform this fourth rearward latching tab 19D-2 downward as shown in FIG. 7, which permits further insertion of the arm-use blade 20D-1.

When the arm-use blade 20D-1 is inserted further and the forward latching protrusions 55D reach a position ahead of the front end of the fourth rearward latching tab 19D-2, the fourth rearward latching tab 19D-2 returns to a free state. As a result, as shown in FIG. 2, the front end of the fourth rearward latching tab 19D-2 is positioned to the rear of the forward latching protrusions 55D and is able to latch the forward latching protrusions 55D, and rearward movement of the arm-use blade 20D-1, and in turn the fourth blade 20D, is restricted. As shown in FIG. 2, at this point, the rear ends of the fourth forward latching tabs 19D-1 are positioned to the front of the rearward latching protrusion 56D and are able to latch the rearward latching protrusion 56D, and consequently forward movement of the arm-use blade 20D-1, and in turn the fourth blade 20D, is restricted.

Also, as shown in FIG. 2, a gap (looseness) is formed between the upper faces of the restricting protrusions 57D and 58D of the arm-use blade 20D-1 (see FIG. 4) and the lower face of the lower bottom partition 18C-2, and the arm-use blade 20D-1 is able to move in the vertical direction with freedom of movement within the range of the above-mentioned gap. In this embodiment, this gap is smaller than the amount by which the latching protrusions 55D and 56D protrude (the height dimension). Therefore, even if the arm-use blade 20D-1 moves upward, the latched state of the fourth rearward latching tab 19D-2 and the forward latching protrusions 55D, and the latched state of the fourth forward latching tabs 19D-1 and the rearward latching protrusion 56D are maintained, so the arm-use blade 20D-1, and in turn the fourth blade 20D, can be positioned in the longitudinal direction, and the fourth blade 20D can be effectively prevented from coming loose from the housing 10. As shown in FIG. 2, in a state in which attachment of the fourth blade 20D is complete, the connection components 33D-1 of the terminals 30D are located below the bottom face 12 of the housing 10.

Next, in the same manner as the above-mentioned attachment of the fourth blade 20D, the arm-use blade 20C-1 of the third blade 20C, the arm-use blade 20B-1 of the second blade 20B, and the arm-use blade 20A-1 of the first blade 20A are respectively inserted, in that order, from the rear into the third holding groove 17C, the second holding groove 17B, and the first holding groove 17A, thereby attaching the blades 20C, 20B, and 20A to the housing 10. As a result, the blades 20A to 20D are held in the housing 10 in a state in which the arm-use blades 20A-1 to 20D-1 are successively spaced apart in the vertical direction, and the leg-use blades 20A-2 to 20D-2 are successively spaced apart in the longitudinal direction.

The blades 20C, 20B, and 20A are similar to the fourth blade 20D in that they are able to move in the vertical direction within the range of the gap (looseness) formed in the holding grooves 17C, 17B, and 17A. Also, as shown in FIG. 2, the connection components 33A-1 to 33C-1 of the terminals 30A to 30C of the blades 20A to 20C are positioned below the bottom face of the bottom wall 12 of the housing 10.

The connector 1 pertaining to this embodiment is mounted on the mounting face of a circuit board in the following manner. First, when the connector 1 is disposed on the above-mentioned mounting face so that the mounting face of the circuit board is opposite the bottom wall 12 of the housing 10, the connection components 33A-1 to 33D-1 of the various types of blades 20A to 20D come into contact with the corresponding circuit parts on the mounting face.

If the height positions of the connection components 33A-1 to 33D-1 of all of the blades 20A to 20D are aligned before the connector 1 is disposed on the above-mentioned mounting face, then even after the connector 1 has been disposed on the mounting face, the blades 20A to 20D will not move obliquely (discussed below), and the state in which the height positions of the connection components 33A-1 to 33D-1 are aligned will remain as is.

Meanwhile, if the height positions of the connection components 33A-1 to 33D-1 of all of the blades 20A to 20D should vary due to manufacturing error or the like before the connector 1 is disposed on the above-mentioned mounting face, in this embodiment, the misalignment of the height positions of the connection components 33A-1 to 33D-1 is automatically corrected when the connector 1 is disposed on the mounting face.

When the connector 1 is disposed on the mounting face, the connection components 33A-1 to 33D-1 come into contact with the above-mentioned corresponding circuit parts and are subjected to an upward contact force from said corresponding circuit parts, and as a result the blades having connection components positioned lower than the other connection components take on an inclined attitude such that the rear parts of the arm-use blades are lifted up within the holding space 17 of the housing 10.

For example, of the connection components 33A-1 to 33D-1, if only the connection component 33A-1 of the first blade 20A is positioned lower than the other connection components 33B-1 to 33D-1, then that connection component 33A-1 will be subjected to the above-mentioned contact force from the corresponding circuit part, and will be lifted upward by an amount equivalent to how much the height position is offset. As a result, the first blade 20A assumes the above-mentioned inclined attitude within the holding space 17 according to how much the connection component 33A-1 has been lifted up. This oblique movement of the first blade 20A occurs within the range of looseness in the vertical direction within the first holding groove 17A, that is, within the range of the gap formed between the first elastic latching tabs 19A and the upper top partition 18A-1 and the arm-use blade 20A-1. Thus putting the first blade 20A in an inclined attitude aligns the height positions of the connection component 33A-1 and the other connection components 33B-1 to 33D-1.

A case in which the height position of the connection component of one type of blade was offset was described here, but the same applies when the height positions of the connection components of a plurality of types of blades are different from one another. That is, any blades other than the blade having the connection component positioned at the highest position in the state prior to disposition on the mounting face of the circuit board will assume the above-mentioned inclined attitude due to the above-mentioned contact force, so the height positions of all of the connection components 33A-1 to 33D-1 will be aligned at the position of the above-mentioned connection component that is positioned highest.

Thus, aligning the height positions of all of the connection components 33A-1 to 33D-1 allows all of these connection components 33A-1 to 33D-1 to be properly brought into contact with the corresponding circuit parts. And, when the connection components 33A-1 to 33D-1 are soldered to the corresponding circuit parts, a good solder connection state can be ensured for all of the connection components 33A-1 to 33D-1. Also, the attachment members 60 are soldered to the corresponding part of the circuit board.

In this embodiment, the arm-use blades 20A-1 to 20D-1 are able to move freely in the vertical direction within the above-mentioned range of looseness within the holding grooves 17A to 17D, and even if the arm-use blades 20A-1 to 20D-1 are tilted, they will not be subjected to any external force, so no residual stress will occur in the connection components 33A-1 to 33D-1 laid out on the mounting face. Therefore, since there is no residual stress at the soldered joints, a good solder connection state can be reliably preserved.

Also, in this embodiment, the restricting protrusions 57A to 57D and 58A to 58D are formed on the arm-use blades 20A-1 to 20D-1, which prevents the inner faces of the holding grooves 17A to 17D from making contact over the entire length with these arm-use blades 20A-1 to 20D-1. Therefore, when the above-mentioned contact force or the elastic force from the elastic latching tabs causes the arm-use blades 20A-1 to 20D-1 to move in the holding grooves 17A to 17D, so that the plate surfaces on the opposite side from the elastic latching tabs 19A and 19B move closer to the inner faces of the holding grooves 17A to 17D, the arm-use blades 20A-1 to 20D-1 will come into contact with the above-mentioned inner faces only at the restricting protrusions 57A to 57D and 58A to 58D. As a result, there is little friction between the arm-use blades 20A-1 to 20D-1 and the holding grooves 17A to 17D, so even if movement of the arm-use blades 20A-1 to 20D-1 in the vertical direction is accompanied by movement in the longitudinal direction, this movement will not be hindered whatsoever.

Next, the configuration of the mating connector 2 will now be described on the basis of FIG. 2. The mating connector 2 has a housing 70 that has a cuboid shape matching the receptacle 15 of the connector 1, a plurality of mating terminals 80 that are held in a row in said housing 70, and an attachment member 90 that is held in said housing 70.

The housing 70 has a bottom wall 71 that is opposite the mounting face of a circuit board (not shown), and peripheral wall that rises up from this bottom wall 71 in the form of a square frame. This peripheral wall has a pair of side walls 72A and 72B that extend in the connector width direction (the direction perpendicular to the paper plane in FIG. 2), and a pair of end walls (not shown) that extend in the vertical direction in FIG. 2 and link the ends of the side walls 72A and 72B together. Also, a pair of middle walls 73A and 73B that rise up from the bottom wall 71 and extend in the connector width direction are formed between the side walls 72A and 72B.

A corresponding receptacle 74 for receiving the mating part of the connector 1 is formed in the space bounded by the above-mentioned peripheral walls. As shown in FIG. 2, in a state in which the mating connector 2 is in an attitude such that the wall face of the bottom wall 71 is at a right angle to the connector insertion direction (the left-and-right direction in FIG. 2), the corresponding receptacle 74 is divided into three spaces: an upper corresponding receptacle 74A, a middle corresponding receptacle 74B, and a lower corresponding receptacle 74C. More specifically, the upper corresponding receptacle 74A is formed between the side wall 72A and the middle wall 73A, the middle corresponding receptacle 74B is formed between the pair of middle walls 73A and 73B, and the lower corresponding receptacle 74C is formed between the side wall 72B and the middle wall 73B. As shown in FIG. 2, the corresponding receptacles 74A, 74B, and 74C are open in the longitudinal direction. Protruding walls 75A, 75B, and 75C that rise up from the bottom wall 12 and extend in the connector width direction are formed in the corresponding receptacles 74A, 74B, and 74C, respectively. In this embodiment, the side walls 72A and 72B, the middle walls 73A and 73B, and the protruding walls 75A, 75B, and 75C form the mating part.

The mating terminals 80 are provided in four rows corresponding to the blades 20A to 20D of the connector 1, and are held so as to extend along the wall faces of the side walls 72A and 72B and the middle walls 73A and 73B, respectively. Each row of a plurality of mating terminals 80 includes mating signal terminals and mating ground signals. These mating signal terminals and mating ground signals in each row are arranged in order to correspond to the signal terminals 30S and ground terminals 30G of the connector 1. In this embodiment, as needed to facilitate the description, the above-mentioned four rows of mating terminals 80 are differentiated as mating terminals 80A, 80B, 80C, and 80D in that order starting from the upper row in FIG. 2.

The mating terminals 80 are made by bending a metal strip in the plate thickness direction, and have elastic arms 81 that extend in the longitudinal direction in FIG. 2, supported parts 82 that are supported by being press-fitted on the bottom wall 12 of the housing 10 and are continuous with the elastic arms 81, and connection components 83 that are bent at a right angle at the ends of the supported parts 82 (the left end in FIG. 2) and are soldered to the corresponding circuit parts (not shown) of the circuit board.

The elastic arms 81A to 81D are capable of elastic deformation in the plate thickness direction (the vertical direction in FIG. 2), and corresponding connection components 81A-1 to 81D-1 that are capable of elastic contact with the terminals 30A to 30D of the connector 1 are formed by bending at the free ends of these elastic arms 81A to 81D. More specifically, as shown in FIG. 2, the corresponding connection components 81A-1 and 81B-1 of the elastic arms 81A and 81B are formed protruding downward, and the corresponding connection components 81C-1 and 81D-1 are formed protruding upward. Also, the elastic arms 81A to 81D are positioned with a gap between them and the corresponding side walls 72A and 72B or middle walls 73A and 73B, and are capable of elastic deformation within the range of the above-mentioned gap in the connector mated state.

As shown in FIG. 2, connection components 83A to 83D are located outside the housing 10, that is, more to the left than the bottom wall 71 in FIG. 2, with the connection components 83A and 83B extending upward, and the connection components 83C and 83D extending downward.

The attachment member 90 is used to attach and fix the mating connector 2 to the circuit board, is made from sheet metal, and as shown in FIG. 2 is held by an attachment component (not shown) on the end wall of the housing 10 so as to protrude more to the left than the bottom wall 71.

The mating connector 2 thus configured is mounted on a circuit board (not shown) by disposing it on the mounting face of the circuit board, soldering the connection components 83A to 83D of the mating terminals 80A and 80B to the corresponding circuit parts of the circuit board, and soldering the attachment member 90 to the corresponding parts of the circuit board.

Next, the operation of mating the connector 1 with the mating connector 2 will be described. First, the connector 1 and the mating connector 2 are mounted on the corresponding mounting face of a circuit board in the manner already discussed. Then, as shown in FIG. 2, the mating part of the mating connector 2 is placed opposite the receptacle 15 of the connector 1 at the front position of the connector 1.

Next, as indicated by the arrow in FIG. 2, the mating connector is moved rearward toward the connector 1, the mating part of the mating connector 2 is inserted into the receptacles 15A to 15C of the connector 1, and the mating part of the connector 1 is inserted into the corresponding receptacles 74A to 74C.

As a result, the front end portion of the arm-use blade 20A-1 of the first blade 20A of the connector 1 (the portion positioned within the upper receptacle 15A) comes into contact with the corresponding connection component 81A-1 of the elastic arm 81A of the mating terminal 80A, and the elastic arm 81A is elastically deformed to the side wall 72A side while being inserted between the elastic arm 81A and the protruding wall 75A. Similarly, the front end portion of the arm-use blade 20D-1 of the fourth blade 20D (the portion positioned in the lower receptacle 15C) is inserted between the protruding wall 75C and the elastic arm 81D of the mating connector 2.

Also, the front end portion of the arm-use blade 20B-1 of the second blade 20B of the connector 1 (the portion positioned within the middle receptacle 15B) comes into contact with the corresponding connection component 81B-1 of the elastic arm 81B of the mating terminal 80B, and the elastic arm 81A is elastically deformed to the middle wall 73A side while being inserted between the elastic arm 81B and the protruding wall 75B. Similarly, the front end portion of the arm-use blade 20C-1 of the third blade 20C (the portion positioned in the middle receptacle 15B) is inserted between the protruding wall 75B and the elastic arm 81C.

Also, the upper protruding walls 16A of the connector 1 are housed in the space between the middle wall 73A and the protruding wall 75A of the mating connector 2 (part of the corresponding receptacle 74A), while the lower protruding walls 16B are housed in the space between the protruding wall 75C and the middle wall 73B (part of the corresponding receptacle 74C).

Also, the side wall 72A and the protruding wall 75A of the mating connector 2 are housed in the upper receptacle 15A of the connector 1. The two middle walls 73A and 73B and the protruding wall 75B of the mating connector 2 are housed in the middle receptacle 15B of the mating connector 2. The side wall 72B and the protruding wall 75C of the mating connector 2 are housed in the lower receptacle 15C of the connector 1.

In a state in which the connector mating is complete, the elastically deformed state of the elastic arms 81A to 81D of the mating terminals 80A to 80D is maintained, and the terminals 30A to 30D of the blades 20A to 20D are in contact under pressure with the corresponding connection components 81A-1 to 81D-1 of the mating terminals 80A to 80D.

In this embodiment, three of the elastic latching tabs were provided in the connector width direction, but the number of elastic latching tabs is not limited to three, so long as forward and rearward movement of the blades can be restricted. Also, in this embodiment, the restricting protrusions of the blades were provided at two locations in the longitudinal direction, but so long as the blades can be prevented from coming into contact over the entire length in the longitudinal direction with the inner faces of the holding grooves, the number of locations in the longitudinal direction where the restricting protrusions are provided is not limited to two. Also, in this embodiment, the arm-use blades and the leg-use blades were such that their plate surfaces formed a right angle to each other, but the angle formed by these plate surfaces is not limited to being a right angle, and may instead be an obtuse angle, for example. Specifically, the arm-use blades and the leg-use blades should be positioned so that their plate surfaces form an angle to each other.

In this embodiment, a connector 1 was described in which various types of blades 20A to 20D, which were made so that the terminals 30A to 30D and the shield plates 40A to 40D were held by the insulating boards 50A to 50D, were held in the housing 10, but this is not the only embodiment of a connector to which the present invention can be applied. For example, in another embodiment, the present invention can be applied to a connector in which the insulating boards and shield plates are eliminated from the blades in the above embodiment, that is, only the terminals are inserted into and held in the housing.

For example, a plurality of types of terminals can be made by punching out substantially L-shaped pieces from sheet metal members so as to maintain the flat surfaces of said sheet metal members, and a plurality of terminals of the same type can be arranged in the connector width direction so that the plate surfaces are parallel. The various types of terminals each have an arm that extends in the longitudinal direction and a leg that extends in the vertical direction, a contact component for contact with a mating terminal is formed on the front end side of the arm, and a connection component for soldering to a circuit board is formed on the lower end side of the leg. Also, upward protrusions that protrude from the upper edge of the arms and downward protrusions that protrude from the lower edge may be formed at a plurality of sites in the longitudinal direction of the arms, with either the upward protrusions or the downward protrusions being used as latching protrusions, and the other as restricting protrusions.

In the other embodiment given above, just as when the blades discussed above are used, the terminals will be able to move in the vertical direction within the holding grooves of the housing, so even if the terminals should move within the holding grooves during the positional correction of the connection components, no stress will remain at the soldered sites between the connection components and the circuit board, and a good solder connection state can be ensured.

BRIEF DESCRIPTION OF THE DRAWINGS

1 connector (right-angle electrical connector)
2 mating connector
10 housing
17 holding space
17A to 17D holding grooves
19A to 19D elastic latching tabs
20A to 20D blades
20A-1 to 20D-1 arm-use blades
20A-2 to 20D-2 leg-use blades
30A to 30D terminals (conductive bar members)
31A to 31D arms
31A-1 to 31D-1 contact components
32A to 32D bent parts
33A to 33D legs
33A-1 to 33D-1 connection components
50A to 50D insulating boards
55A to 55D forward latching protrusions (latching protrusions)
56A to 56D rearward latching protrusions (latching protrusions)
57A to 57D forward restricting protrusions (restricting protrusions)
58A to 58D rearward restricting protrusions (restricting protrusions)
80A to 80D mating terminals (corresponding terminals)

The invention claimed is:

1. A right-angle electrical connector in which a plurality of conductive bar members are held side by side by an insulating board to form a type of blade, a mating part for insertion and removal of a mating connector is formed at the front part of a housing in the interior of which is formed a holding space for holding a plurality of types of blades of different lengths in the lengthwise direction of the conductive bar members, and a circuit board attachment face is provided on the bottom of the housing, having an angle that is perpendicular to said front part, the conductive bar members held on the insulating board by the various types of blades each have an arm that extends in a straight line in the insertion and removal direction and a leg that is linked via a bent part to the rear end of the arm and extends downward toward the bottom, and contact components for coming into contact with the corresponding terminals of a mating connector are formed at the front end of the arms, and contact components that are soldered to the corresponding circuit parts of the circuit board are formed at the lower end of the legs, wherein the various types of blades are such that arm-use blades in which an arm is held and leg-use blades in which a leg is held are linked at the bent parts of the conductive bar members so that the blade planes form an angle, the plurality of types of blades are such that the lengths of the legs and the arms of the conductive bar members of the various types of blades are set so that the arm-use blades are successively positioned in the vertical direction and the leg-use blades in the longitudinal direction with spaces in between, the housing is such that holding grooves are formed that permit the arm-use blades of the various types of blades to be inserted from the rear, and connection components provided to the lower ends of the legs of the conductive bar members of the various types of blades are located outside the housing, the arm-use blades of the various types of blades are able to move in the vertical direction over a specific range within the corresponding holding grooves, and the various types of blades are able to move within the holding space.

2. The right-angle electrical connector according to claim 1, wherein the arm-use blades are provided with latching protrusions at two locations separated in the longitudinal direction, two types of elastic latching tabs that latch the latching protrusions at the above-mentioned two locations are provided on the inner faces of holding grooves in the housing, and when the arm-use blades are inserted from the rear into the holding grooves, the elastic latching tabs are compressed by the arm-use blades and elastically deformed, which permits the insertion of the arm-use blades, and when the arm-use blades have been inserted to a specific position, the two types of elastic latching tabs are positioned between the two latching protrusions, one of the two types of elastic latching tabs is latched with the rear latching tab to restrict forward movement of the arm-use blades, and the other elastic latching tab latches with the forward latching tab to restrict rearward movement of the arm-use blades.

3. The right-angle electrical connector according to claim 1, wherein the arm-use blades are provided with restricting protrusions that prevent contact over the entire length of the arm-use blades with the inner faces of the holding grooves when the arm-use blades have moved in the vertical direction within the holding grooves.

4. The right-angle electrical connector according to claim 1, wherein the arm-use blades are such that an insulating coating is given to the arms in a proximity range that minimizes the gap between the arms of the conductive bar members and the elastic latching tabs of the housing.

5. A right-angle electrical connector in which a plurality of types of conductive bar members of different lengths are held in a holding space of a housing, and said conductive bar members each have an arm that extends in a straight line in the insertion and removal direction and a leg that is linked via a bent part to the rear end of the arm and extends downward toward the bottom, and contact components for coming into contact with the corresponding terminals of a mating connector are formed at the front end of the arms, and contact components that are soldered to the corresponding circuit parts of the circuit board are formed at the lower end of the legs, wherein the plurality of types of conductive bar members are such that the lengths of the legs and the arms are set so that the arms are successively positioned in the vertical direction and the legs in the longitudinal direction with spaces in between, the housing is such that holding grooves are formed that permit the arms of the various types of conductive bar members to be inserted from the rear, and connection components provided to the lower ends of the legs of the various types of conductive bar members are located outside the housing, the arms of the various types of conductive bar members are able to move in the vertical direction over a specific range within the corresponding holding grooves, and the various types of conductive bar members are able to move within the holding space.

* * * * *